United States Patent [19]

Ueda et al.

[11] Patent Number: 4,781,115

[45] Date of Patent: Nov. 1, 1988

[54] TABLET PRINTING MACHINE WITH ROLL CLEANING SYSTEM

[75] Inventors: Yoshio Ueda, Kobe; Kenichi Nishimura, Takatsuki; Yoshiaki Mochizuki, Osaka; Atsuo Ohike, Nishinomiya; Takayoshi Honda, Takatsuki; Eiji Shiba, Izumi, all of Japan

[73] Assignee: Fujisawa Pharmaceutical Co., Ltd., Osaka, Japan

[21] Appl. No.: 938,467

[22] Filed: Dec. 5, 1986

[30] Foreign Application Priority Data

Dec. 6, 1985 [JP] Japan ..... 60-275825
Dec. 13, 1985 [JP] Japan ..... 60-281693

[51] Int. Cl.[4] ..... B41F 17/36; B41F 35/06

[52] U.S. Cl. ..... 101/425; 15/256.51; 118/688; 118/712; 250/562; 101/35

[58] Field of Search ..... 101/425, 40, 423, 424, 101/416 R, 167, 162, 166, 156, 35; 15/256.51, 256.52; 118/691, 690, 688, 712, 713; 250/562, 563

[56] References Cited

U.S. PATENT DOCUMENTS

| | | | |
|---|---|---|---|
| 3,096,443 | 7/1963 | Laycak | 250/562 X |
| 3,592,136 | 7/1971 | Selman | 101/425 |
| 3,693,547 | 9/1972 | Morgan | 15/256.52 X |
| 3,737,940 | 6/1973 | Moestue et al. | 101/425 X |
| 4,054,377 | 10/1977 | Gibson | 250/563 X |
| 4,216,714 | 8/1980 | Ackley, Sr. et al. | 101/425 X |
| 4,298,807 | 11/1981 | Favre | 250/562 |
| 4,298,808 | 11/1981 | Hill | 250/563 |
| 4,468,120 | 8/1984 | Tanimoto et al. | 250/563 X |

FOREIGN PATENT DOCUMENTS

| | | | |
|---|---|---|---|
| 3984 | 1/1980 | Japan | 101/425 |

*Primary Examiner*—Clifford D. Crowder
*Attorney, Agent, or Firm*—Oblon, Fisher, Spivak, McClelland & Maier

[57] ABSTRACT

A tablet printing machine provided with a roll soiling detecting unit for optically detecting soiling of the surface of a roll of its printing unit. The machine is further provided with a roll cleaning unit including a cleaner to be impregnated with a cleaning liquid and adapted for pressing contact with the transfer roll of the printing unit during the rotation of the roll.

5 Claims, 10 Drawing Sheets

TABLET PRINTING MACHINE WITH ROLL CLEANING SYSTEM

BACKGROUND OF THE INVENTION

The present invention relates to a tablet printing machine.

Generally, tablet printing machines comprise a design roll (gravure roll), a transfer roll and a feed roll which are rotated continuously at a high speed Code numbers are engraved in the surface of the design roll, the lower portion of which is held placed in an ink fountain. When the design roll moves past the interior of the ink fountain, the ink adhering to the roll surface is scraped off by a doctor blade except at the recessed portions engraved with the code numbers, and only the ink remaining in the recessed portions is transferred to the surface of the transfer roll which is made of rubber. The ink transferred to the transfer roll surface is then transferred to the surfaces of tablets held on the feed roll. At this time, particles of tablets and coating fragments thereof gradually accumulate on the transfer roll surface, while broken pieces of tablets, soils in the ink, etc. are likely to adhere to the transfer roll surface. The extraneous substances and ink soils thus adhering to and soiling the transfer roll surface produce faulty prints, so that there arises a need to clean the roll surface. However, the kind of soils on the surface of the transfer roll and the progress of soiling with time differ with the shape of tablets, formulation of coating agents, etc., while tablets break accidentally. Accordingly, the transfer roll surface will not be fully cleaned when cleaned only periodically. Although the operator usually observes with the unaided eye changes in the soiling surface of the transfer roll during operation, the roll surface rotating at a high speed is extremely difficult to monitor for accurate checking of soiling. In recent years, investigations are under way in various fields for the detection of soils on the surface of articles by an image processing system, whereas even the image processing system encounters difficulties in detecting soils on the surface which is moving at a high speed. Moreover, the processing software is very costly to develop.

The extraneous matter and ink soils adhering to the transfer roll surface is removed therefrom conventionally by cleaning the surface with a cleaning material impregnated with a cleaning liquid and manually held by the operator against the rotating roll surface during an interruption of printing operation. However, this procedure requires much time and involves safety problems. It is therefore desired to automatically clean the roll, but the following problems still remain to be solved for realizing the automation. In automating cleaning of the printing machine transfer roll, a cleaning unit including a mechanism for automatically pressing a cleaning material or cleaner against the roll surface must be incorporated into the printing machine within a limited space available. Further since the cleaning liquid soiled by cleaning is likely to conversely soil the roll, the cleaner needs to be replaced frequently and is therefore cumbersome to handle.

SUMMARY OF THE INVENTION

An object of the present invention is to provide a tablet printing machine capable of automatically detecting surface soiling of a roll.

Another object of the present invention is to provide a tablet printing machine capable of automatically cleaning the surface of its transfer roll.

Another object of the present invention is to provide a tablet printing machine adapted to automatically clean the surface of a roll upon automatically detecting soiling of the roll surface.

Another object of the present invention is to provide a tablet printing machine equipped with an economical roll soiling detecting unit for automatically and reliably detecting the soiling of the surface of a roll rotating at a high speed.

Another object of the present invention is to provide a tablet printing machine equipped with a roll cleaning unit which can be incorporated into the printing unit of the machine within a limited space easily.

Still another object of the present invention is to provide a tablet printing machine equipped with a roll cleaning unit which is less likely to conversely soil the cleaned roll with the cleaning liquid soiled by cleaning and in which the cleaner need not be replaced frequently.

The present invention provides a tablet printing machine characterized in that the machine comprises a roll soiling detecting unit for optically detecting soiling of the surface of a roll of the printing unit of the machine.

Thus, the tablet printing machine of the invention is adapted to automatically detect surface soiling of the roll.

The invention further provides a tablet printing machine characterized in that the machine comprises a roll cleaning unit which includes a cleaner to be impregnated with a cleaning liquid and adapted for pressing contact with the rotating transfer roll of the printing unit.

The tablet printing machine of the invention automatically removes soils from the surface of the transfer roll without necessitating manual cleaning unlike the conventional machine, assures savings in labor and is very safe and economical since no labor cost is required.

The invention further provides a tablet printing machine characterized in that the machine comprises a roll soiling detecting unit for optically detecting soiling of the surface of a roll of the printing unit of the machine, and a roll cleaning unit including a cleaner to be impregnated with a cleaning liquid and adapted for pressing contact with the rotating transfer roll of the printing unit.

The tablet printing machine of the invention is therefore adapted to automatically clean the surface of the transfer roll upon automatically detecting soiling of the roll surface.

The roll soiling detecting unit of the tablet printing machine of the invention preferably comprises a photoelectric detector of the reflection type opposed to the surface of the roll of the printing unit, and a signal processing circuit for detecting the surface soiling of the roll from variations in reflectivity based on the output signal of the photoelectric detector.

The surface soiling of the roll rotating at a high speed can then be detected automatically and reliably. Since the photoelectric detector is used, the signal processing circuit can be of relatively simple construction, making it possible to construct the roll soiling detecting unit at a relatively low cost.

Preferably, thephotoelectric detector of the reflection type comprises a projector-receiver assembly including a light projector and a light receiver, and a projecting optical fiber and a receiving optical fiber connected respectively to the projector and the receiver and opposed to the surface of the roll.

The optical fibers thus used make it possible to detect soils with ease even at a location of limited space around the roll of the tablet printing machine.

Preferably, the signal processing circuit comprises at least one of a circuit for removing from the output signal of the photoelectric detector a component of frequencies lower than a predetermined frequency to remove noises due to ink soils on the roll surface or roll eccentricity, and a circuit for removing from the detector output signal a component of frequencies higher than a predetermined frequency to remove noises due to soiling of the roll surface by tablets or surface irregularities.

Preferably, the roll cleaning unit of the tablet printing machine of the present invention comprises a cleaning roll, drive means for intermittently driving the cleaning roll, a cleaner wound around the outer periphery of the cleaning roll, and means for supplying the cleaning liquid to the cleaner.

The cleaning roll needs only to be installed in parallel with the transfer roll of the printing unit and can therefore be readily incorporated into the tablet printing machine within a limited space.

Further preferably, the roll cleaning unit of the tablet printing machine embodying the invention comprises a cleaning roll having a plurality of furrows formed in its outer periphery and dividing the outer periphery into a plurality of ridges circumferentially thereof, drive means for intermittently rotating the cleaning roll by one or at least two ridge pitches at a time, a cleaner wound around the outer periphery of the cleaning roll along the ridges and the furrows, and means for supplying the cleaning liquid to the cleaner at the portions thereof over the ridge surfaces along the outer periphery of the cleaning roll.

Since the peripheral surface of the cleaning roll is divided into the plurality of ridge portions b the furrows, the transfer roll can be cleaned a plurality of times with one sheet of cleaner without the necessity of frequently replacing the cleaner. Further because the cleaner is provided around the outer periphery of the cleaning roll over the ridge portions and the furrowed portions, the cleaning liquid soiled by cleaning will not splash the unused portion of the cleaner. This reduces the likelihood that the soiled cleaning liquid will conversely soil the roll.

DESCRIPTION OF THE PREFERRED EMBODIMENTS

Figure 1:
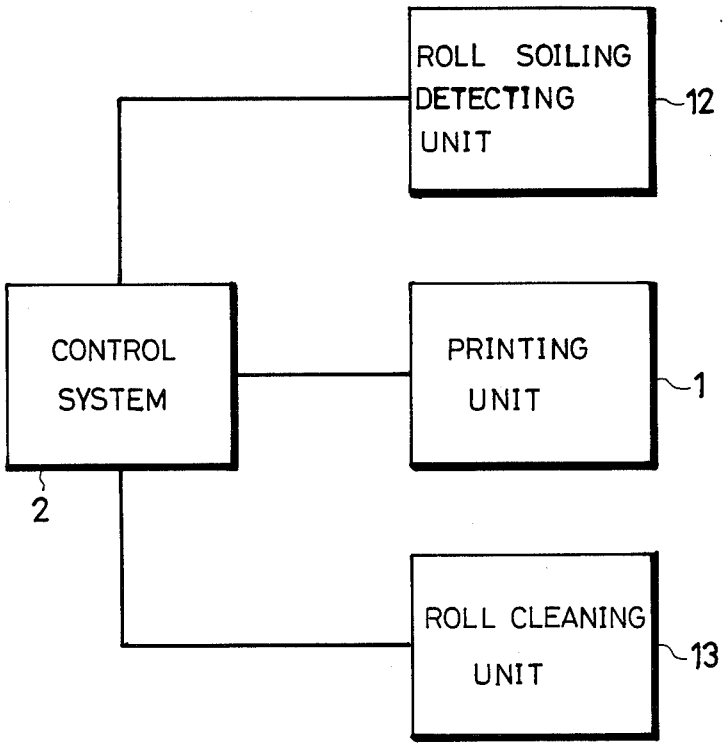
FIG. 1 is a block diagram schematically showing the construction of a tablet printing machine embodying the present invention.

FIG. 1 schematically shows the construction of a tablet printing machine. The printing machine comprises a printing unit 1 including a transfer roll 10, a design roll 11, a feed roll, etc., a roll soiling detecting unit 12 for optically detecting soiling of the surface of the design roll or transfer roll of the printing unit 1, a roll cleaning unit 13 for cleaning the surface of the transfer roll 10 of the unit 1, and a control system 2 for controlling the printing unit 1 and the roll cleaning unit 13 in accordance with the output signal of the roll soiling detecting unit 12.

Figure 2:
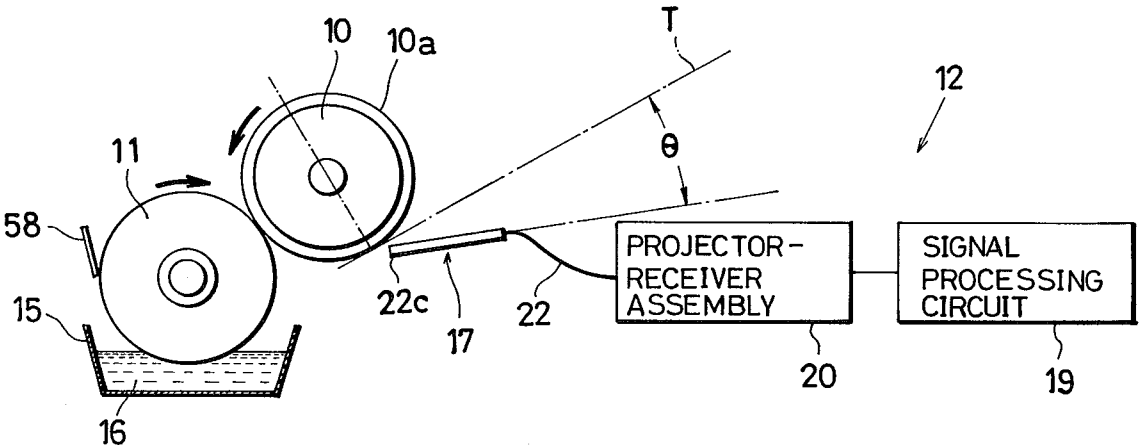
FIG. 2 is a diagram showing a transfer roll and a design roll of the printing unit of the machine and also schematically showing the construction of a unit for detecting soiling of the transfer roll.
Figure 3:
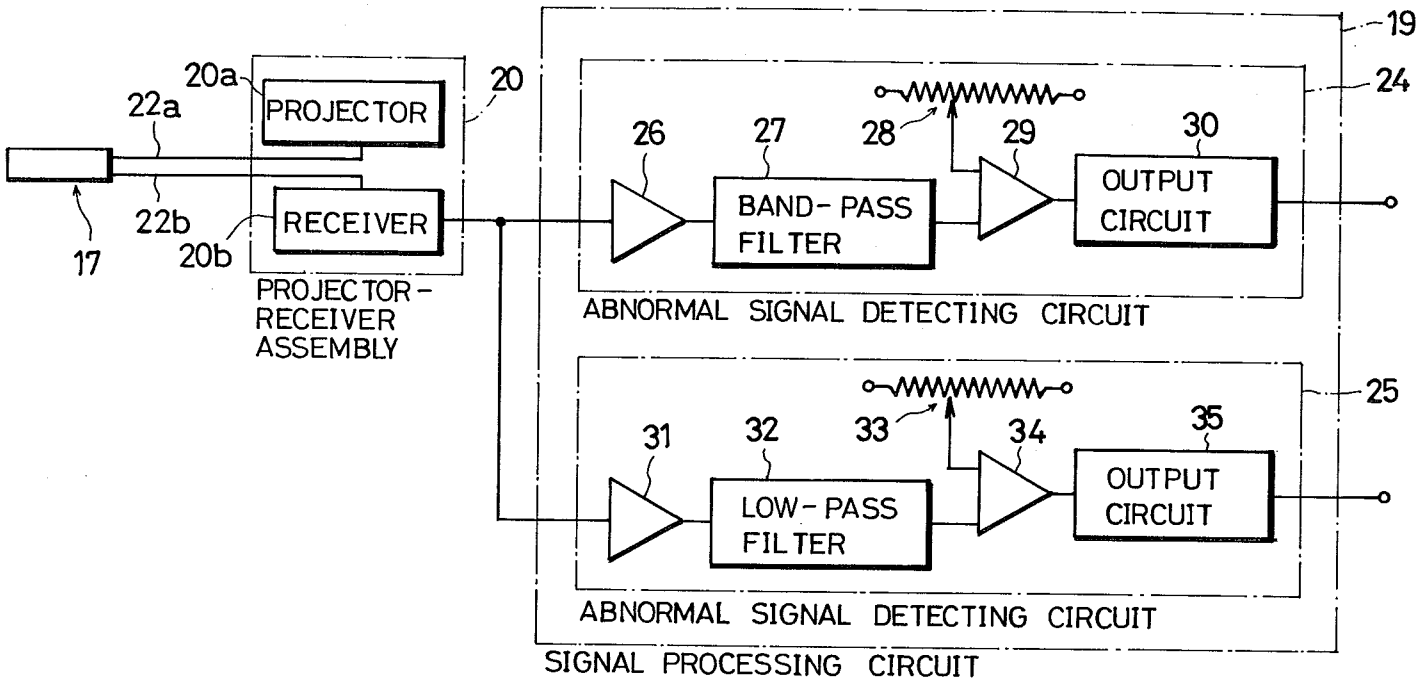
FIG. 3 is a circuit diagram showing the electrical construction of the soiling detecting unit.
Figure 4:
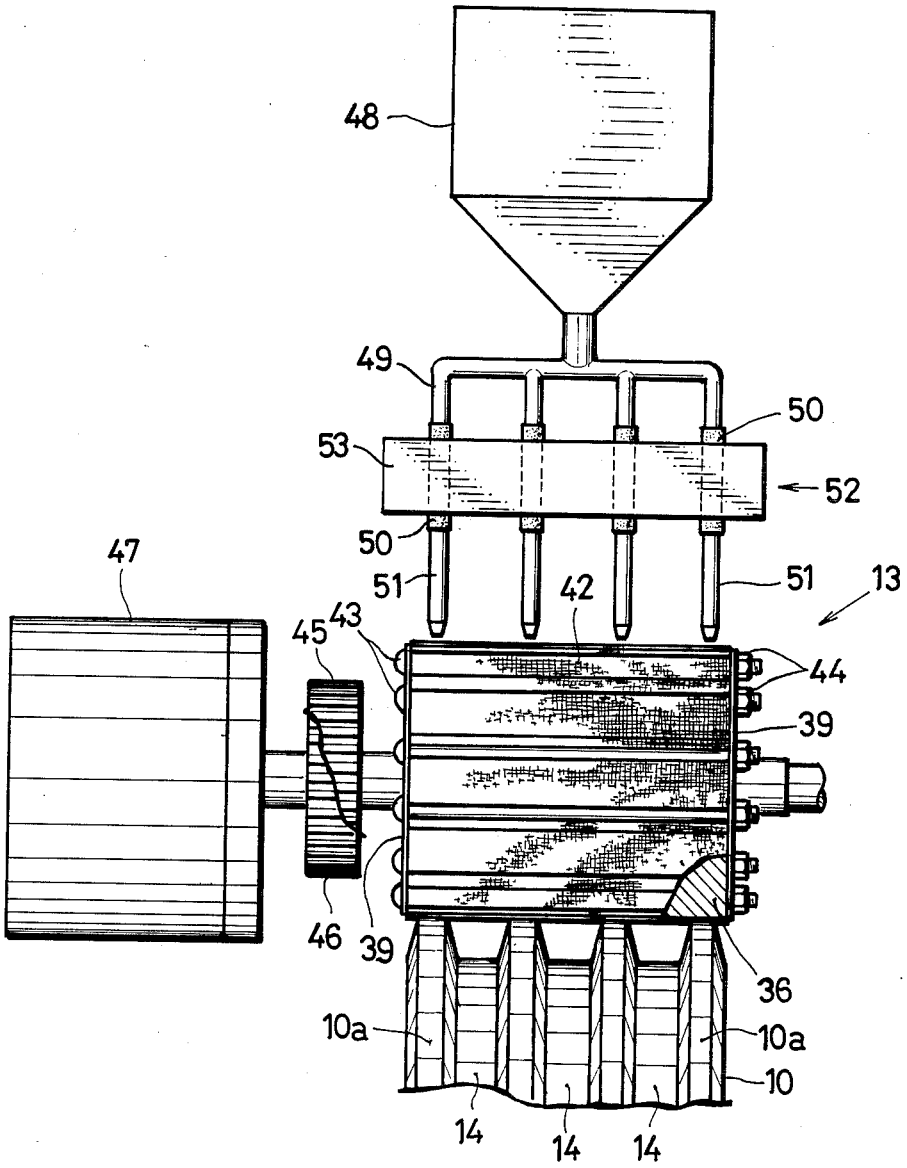
FIG. 4 is a front view partly broken away and showing a portion of the transfer roll and a cleaning unit therefor.
Figure 5:
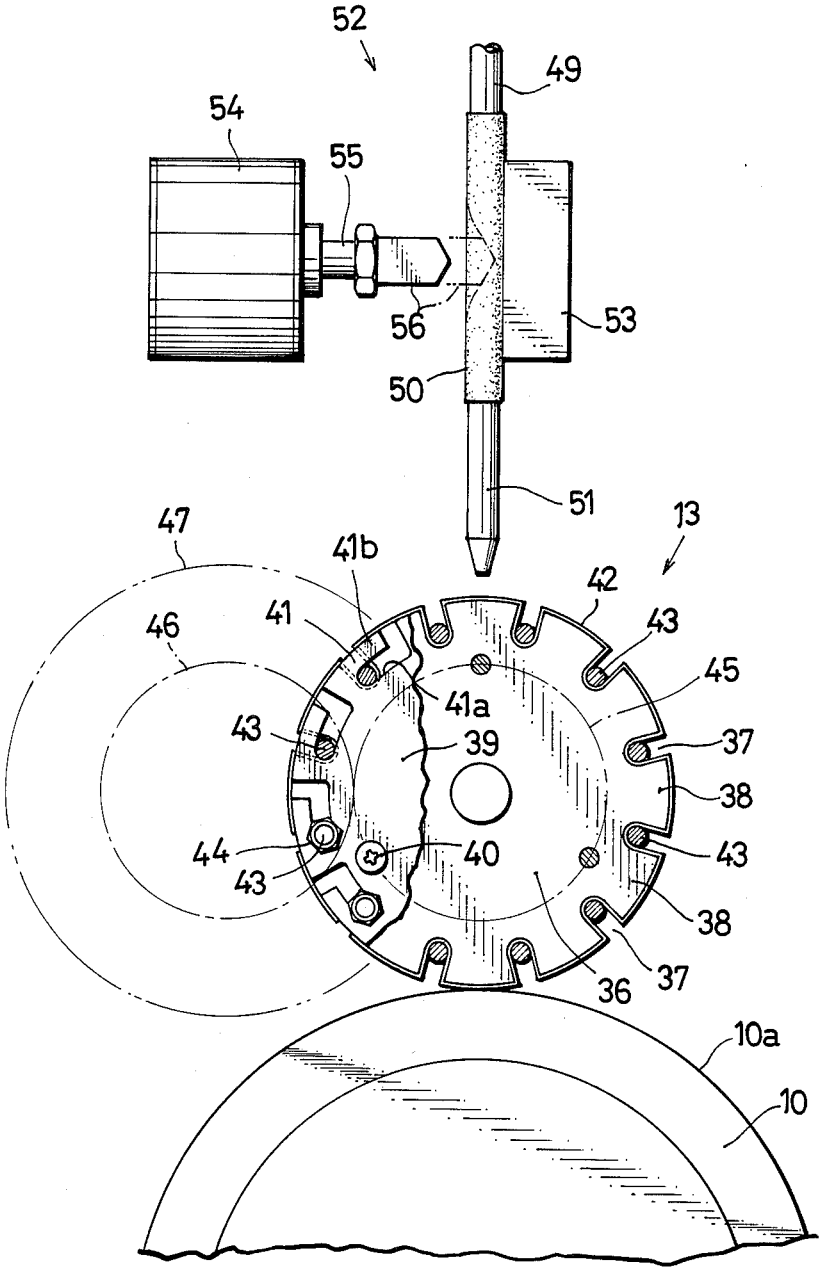
FIG. 5 is a fragmentary side elevation partly broken away and showing the same.
Figure 6:
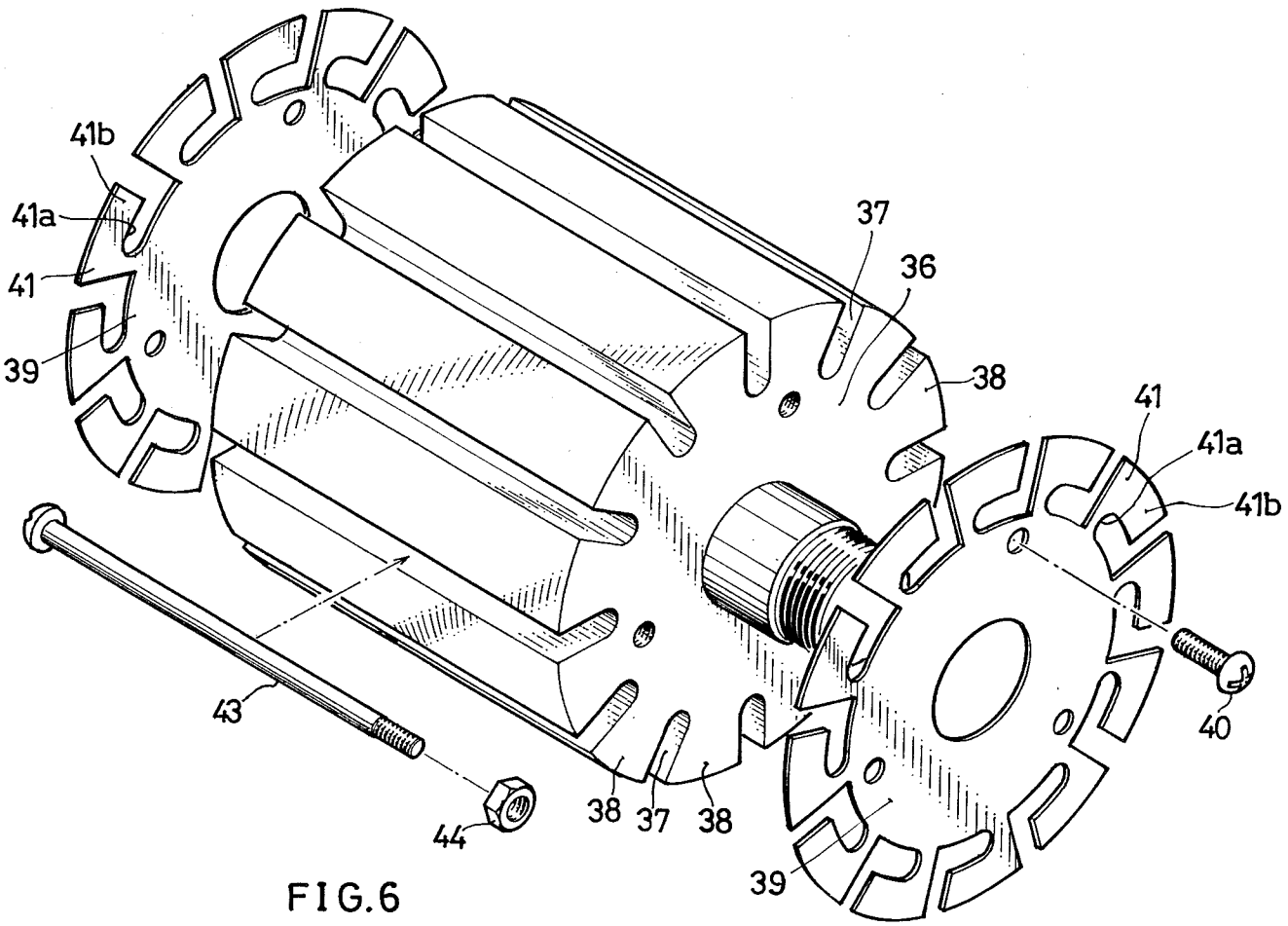
FIG. 6 is a perspective view showing a cleaning roll.

FIGS. 2 and 3 show the transfer roll 10 and the design roll 11 of the printing unit 1, and the soiling detecting unit 12 therefor. FIGS. 4 to 6 show the transfer roll 10 and the cleaning unit 13 therefor.

The transfer roll 10, which is made of rubber, is formed in its outer periphery with a plurality of equidistantly spaced annular grooves 14. Between these grooves 14 and at opposite sides of the roll 10, the outer periphery provides ink transfer surfaces 10*a*. The surface of the design roll 11 is mirror-finished and is formed, along a circumference corresponding to each transfer surface 10*a* of the transfer roll 10, with a plurality of recessed portions (not shown) equidistantly spaced apart circumferentially of the roll 11 and each engraved with a code number. (For example, 36 recessed portions are arranged in a row over the entire circumference.) The design roll 11 has its lower portion immersed in ink 16 in an ink fountain 15 and is rotatable at a high speed (e.g. 80 r.p.m.) in one direction. The transfer roll 10 is disposed between the design roll 11 and the feed roll (not shown) and is rotatable at a high speed (e.g. 80 r.p.m.) in the other direction in opposite relation to the design roll 11. The transfer roll 10 is suitably selectively positionable in an operative position where the transfer surfaces 10*a* are in contact with the design roll 11 and contact the tablets held on the feed roll for printing, or a non-operative position where the roll 10 is a short distance away from the other rolls. The roll 10 is rotatable at each of these positions.

The soiling detecting unit 12 comprises a photoelectric detector 17 of the reflection type and a signal processing circuit 19. The photoelectric detector 17 comprises a projector-receiver assembly 20 including a light projector 20*a* and a light receiver 20*b*, and an optical fiber assembly 22 optically coupled to the assembly 20 by a connector (not shown). The optical fiber assembly 22 is composed of a projecting optical fiber 22*a* optically coupled to the projector 20*a* and a receiving optical fiber 22*b* optically coupled to the receiver 20*b*. The free ends of the two optical fibers 22a and 22b are bundled together to provide the forward end 22c of the fiber assembly 22. The end 22c is opposed to the transfer surface 10a of the transfer roll 10. A tangential line T to the transfer surface 10a makes an angle $\theta$ of 30 to 90 degrees, preferably 30 to 70 degrees, with the forward end 22c of the optical fiber assembly 22. The signal processing circuit 19 comprises two circuits, i.e., first and second abnormal signal detecting circuits 24 and 25. The first abnormal signal detecting circuit 24 comprises a voltage amplifier 26 for amplifying the output signal of the light receiver 20b of the detector 17, a band-pass filter 27 for removing from the output signal of the amplifier 26 a component of low frequencies, for example, of up to 2 Hz and a component of high frequencies, for example, of not lower than 100 kHz, a voltage comparator 29 for comparing the output signal of the filter 27 with a discrimination reference value preset on a setting device 28, and an output circuit 30 for producing a soil detection signal based on the output signal of the comparator 29. The circuit 24 is adapted to detect chiefly soiling of the transfer surfaces 10a of the roll 10 by tablets, from the output signal of the detector 17, i.e. variations in reflectivity. The band-pass filter 27 is intended to remove the low-frequency component from the output signal of the detector 17 to remove low-frequency noises due to ink soils or eccentricity of the roll 10. The band-pass filter 27 may be replaced by a high-pass filter. The second abnormal signal detecting circuit 25 comprises a voltage amplifier 31 for amplifying the output signal of the light receiver 20b of the detector 17, a low-pass filter 32 for removing from the output signal of the amplifier 31 a component of frequencies, for example, of not lower than 4 Hz, a voltage comparator 34 for comparing the output signal of the filter 32 with a discrimination reference value preset on a setting device 33, and an output circuit 35 for producing a soil detection signal based on the output signal of the comparator 34. The circuit 25 is adapted to detect soils in the ink on the transfer surface 10a of the roll 10, from the output signal of the detector 17, i.e., variations in reflectivity. The low-pass filter 32 is designed to remove the frequency component, for example, of at least 4 Hz from the output signal of the detector 17 to remove noises due to soiling of the transfer surfaces 10a of the roll 10 by tablets. The reference value for the discrimination of soiling is optionally set on each of the devices 28 and 33 from outside. The photoelectric detector 17 may be provided for only one of the transfer surfaces 10a of the roll 10, or for each of the surfaces 10a. Further one or at least two detectors are provided for one transfer surface 10a.

The roll cleaning unit 13 comprises a cleaning roll 36 disposed above the transfer roll 10 in parallel therewith. The cleaning roll 36 is formed in its outer periphery with a plurality of furrows 37 in parallel with the roll axis and dividing the periphery into a plurality of ridges 38 which are equidistantly spaced apart circumferentially of the roll. A disk 39 is fastened to each end of the cleaning roll 36 with screw 40. The disk 39 is formed along its outer periphery with projections 41 equal in number to the number of the furrows 37 in the cleaning roll 36 and equidistantly spaced apart. The projection is L-shaped and has a cutout 41a at its base portion. The cutout 41a is in register with the bottom portion of the furrow 37 at the end thereof opposed to the disk. The forward end of the projection 41 is in register with the opening portion of the furrow 37 at its end to close the opening. A cleaner 42 is wound around the outer periphery of the cleaning roll 36 along the ridge portions 38 and the furrowed portions 37. A nut 44 is screwed on each end of a bolt 43 extending through each furrow 37 over the cleaner 42 on the bottom of the furrow from the cutout 41a in one of the disks 39 to the cutout 41a in the other disk 39, whereby the cleaner 42 is fixed to the cleaning roll 36. While a sheet of nylon, paper, sponge or the like is useful as the cleaner 42, the nylon sheet is desirable. The cleaning roll 36 is coupled to a pulse motor 47 or the like by gears 45 and 46 and is intermittently rotated by one or at least two ridge pitches at a time. Provided above the cleaning roll 36 is a tank 48 for a cleaning liquid such as alcohol. A branch pipe 49 having a plurality of branches at its lower end is connected to the bottom of the tank 48. A cleaning liquid dropping nozzle 51 is connected by a flexible tube 50 to the lower end of each branch of the pipe 49. The nozzles 51 are fixedly arranged immediately above the cleaning roll 36 in corresponding relation to the transfer surfaces 10a of the transfer roll 10. The flexible tubes 50 are provided with a pinch valve 52, which comprises a bearing plate 53 fixedly disposed at one side of the tubes 50, a cylinder 54 disposed at the other side of the tubes 50 and an actuator 56 fixed to the free end of the rod 55 of the cylinder 54. When the actuator 56 is moved toward the tubes 50 to press the tubes 50 against the bearing plate 53, the valve 52 is closed to close the flow channels through the tubes 50. Conversely, when moved in the opposite direction away from the tubes 50, the actuator 56 opens the valve 52 to open the flow channels.

The printing unit 1, the roll soiling detecting unit 12, the roll cleaning unit 13 and the control system 2 of the foregoing tablet printing machine operate in the following manner.

During printing operation, the transfer roll 10 is in its operative position away from the cleaning roll 36. A this time, the cleaning roll 36 is at rest, with the pinch valve 52 closed. When the design roll 11 rotates through the ink fountain 15, the ink adheres to the surface of the roll 11. The ink thus adhering to the surface of the design roll 11 is scraped off the roll surface by a doctor blade 58 except the recessed portions engraved with the code numbers. Only the ink portion remaining in the recessed portions is transferred to the transfer surfaces 10a of the transfer roll 10, from which the ink is further transferred to the surfaces of the tablets retained on the feed roll. During the printing operation, the soiling detecting unit 12 detects soiling of the transfer surfaces 10a of the transfer roll 10 in the following manner.

Figure 7:
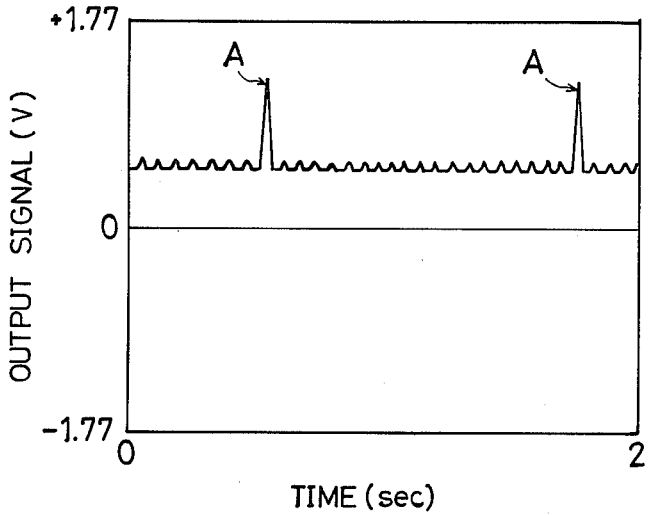
FIG. 7 is a graph showing an example of output signal from a band-pass filter of a first abnormal signal detecting circuit included in the soiling detecting unit.
Figure 8:
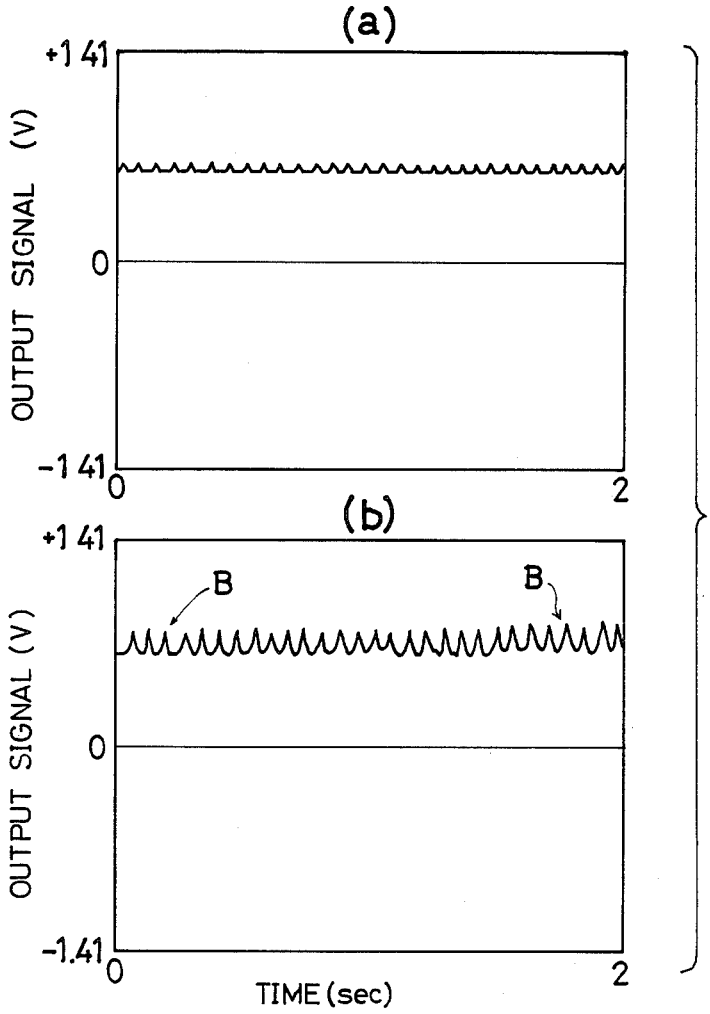
FIGS. 8 (*a*) and (*b*) are graphs showing the output signal of the band-pass filter immediately after the start of printing and when the transfer roll has bee soiled with particles of tablets, etc., respectively.
Figure 9:
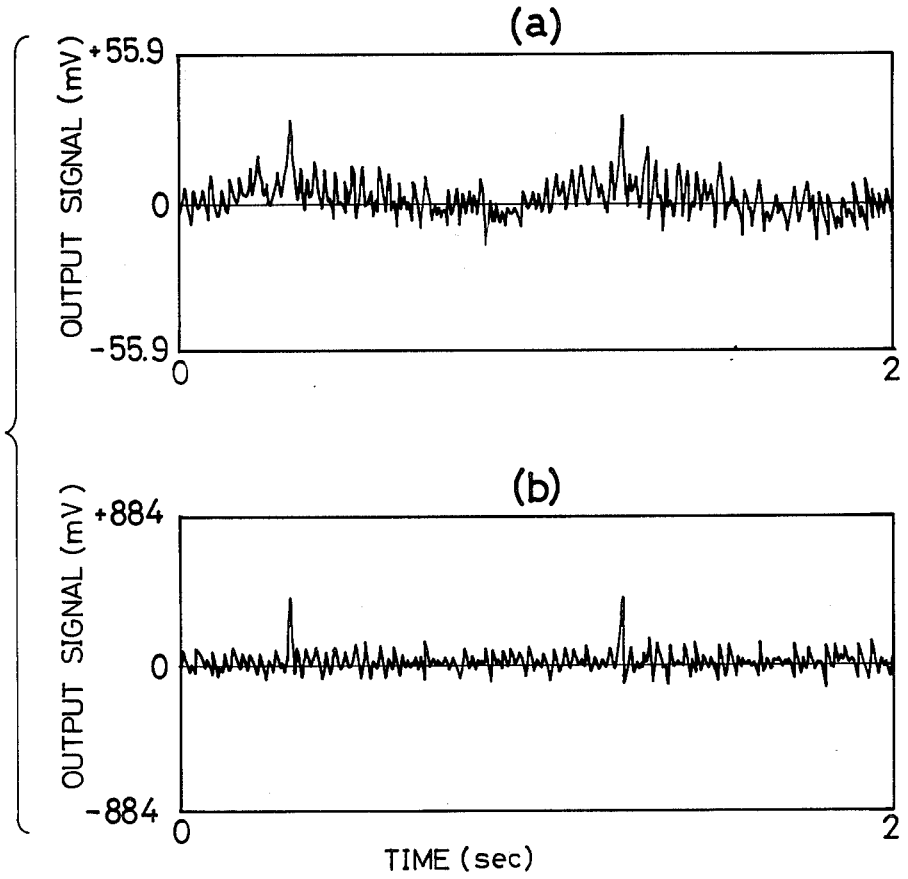
FIGS. 9 (*a*) and (*b*) are a graph showing an example of output signal from a photoelectric detector and a graph showing the corresponding output signal from the band-pass filter.

With the rotation of the transfer roll 10, the output signal of the band-pass filter 27 of the first abnormal signal detecting circuit 24 varies as shown in FIG. 7. When an extraneous substance, such as particles or broken pieces of tablets or coating pieces, adheres to the transfer surface 10a, a high pulse A is emitted. If the peak value of the pulse A is greater than the discrimination reference value, the output circuit 30 produces a soil detection signal for a specified period of time. While FIG. 8 (*a*) shows the output signal of the band-pass filter 27 immediately after the start of printing, the peak value of the pulses of the output signal also increases when the soiling of the transfer surface 10a increases as shown in FIG. 8 (*b*). If the peak value of these pulses B exceeds the discrimination reference value, the output circuit 30 similarly produces a soil detection signal. For example, when the ink on the transfer roll 10 contains soils, the output signal of the photoelectric detector 17, i.e. the output signal of the amplifier 26 varies as shown in FIG. 9 (*a*). Thus, the soiling of the ink on the roll 10 appears as drift of the base potential. Since the drift produces a noise in detecting the pulses A and B, the band-pass filter 27 removes the drift portion as illustrated in FIG. 9 (*b*), and the pulses A and B are detected from the resulting output signal so that the soiling of the roll surface by tablets can be detected with improved accuracy.

Figure 10:
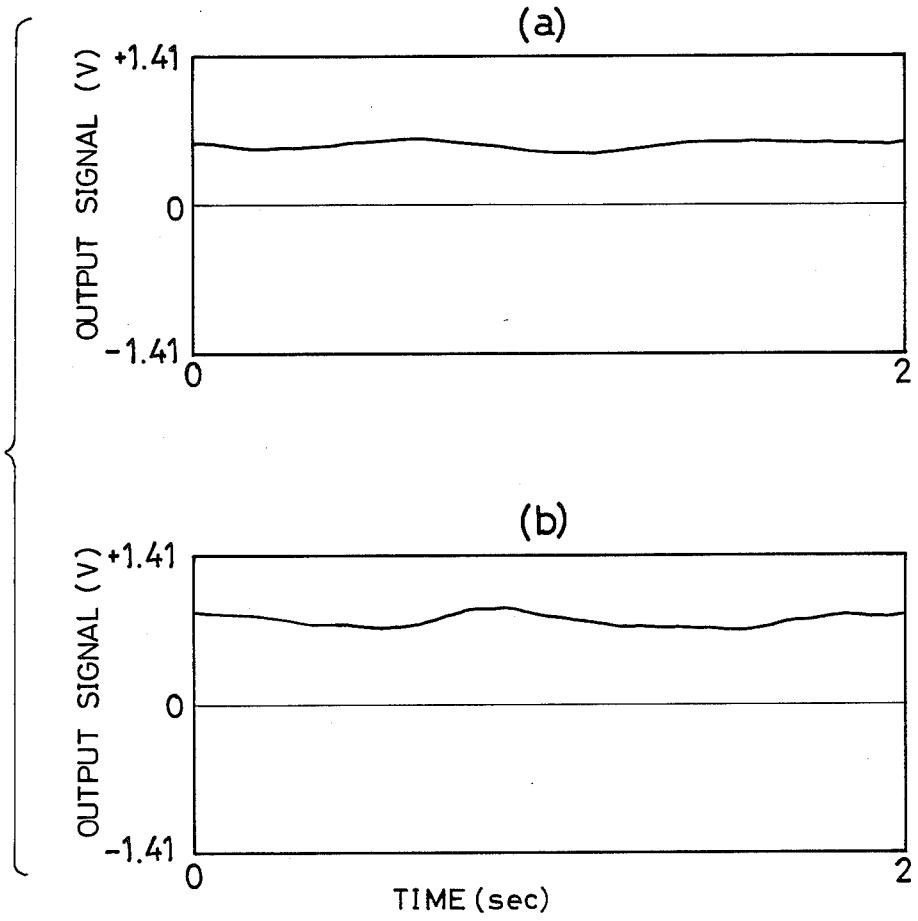
FIGS. 10 (*a*) and (*b*) are graphs showing the output signal of a low-pass filter immediately after the start of printing and when the ink on the transfer roll has been soiled.

On the other hand, the transfer surfaces 10*a* of the transfer roll 10 are checked for the soiling of the ink by the second abnormal signal detecting circuit 25. While FIG. 10 (*a*) shows the output signal of the low-pass filter 32 of the circuit 25 immediately after the start of printing, the output signal varies as shown in FIG. 10 (*b*) with the rotation of the transfer roll 10. When soils in the ink adhere to the transfer surface 10*a*, drift occurs in the base potential. If the drift of the base potential is greater than the discrimination reference value, the output circuit 35 produces a soil detection signal for a specified period of time. Since a component of relatively high frequencies due to the soiling by tablets would be also detected at the same time, the low-pass filter removes this component to detect the soiling of the ink with improved accuracy.

When the soiling of the transfer roll 10 is thus detected, the control system 2 automatically stops the printing machine and operates the cleaning unit 13 to automatically clean the transfer roll 10 in the following manner.

When the printing machine is stopped, the pinch valve 52 is opened first for a predetermined period of time, dropwise applying a specified quantity of cleaning liquid to the ridge portion 38 at the top of the cleaning roll 36 to impregnate the cleaner 42 at the portion thereof over this ridge portion 38 with the liquid. Next, the cleaning roll 36 is rotated until the top ridge portion 38 comes to the lowermost position immediately below the top, whereupon the roll 36 is halted. The transfer roll 10 is moved to its non-operative position to bring the transfer surfaces 10*a* into pressing contact with the impregnated portion of the cleaner 42 on the ridge 38. The transfer roll 10 is rotated with the cleaning roll 36 held at rest, whereby the transfer surfaces 10*a* are cleaned. Upon completion of cleaning, the transfer roll 10 is brought to the operative position away from the cleaning roll 36 to resume printing operation. At the same time, the cleaning roll 36 is rotated until the ridge portion 38 used for cleaning moves past the top of the cleaning roll 36 to a position one ridge pitch beyond the top, whereupon the roll 36 is stopped. This positions the ridge portion 38 immediately following the used ridge portion 38 at the top of the roll 36. The fresh portion of the cleaner 42 over this ridge portion 38 is next used for cleaning. In this way, one sheet of cleaner 42 can be used for cleaning a number of times equal to the number of the ridges 38. Further depending on the material of the cleaner 42, the portion of the cleaner 42 over one ridge 38 is usable for cleaning at least two times. Since the cleaner 42 extends along the furrowed portion 37 between each two adjacent ridges 38 and is fixed to the roll by the bolt 43, it is unlikely that the cleaning liquid soiled by cleaning will splash the cleaner 42 over the unused ridge portions 38. After one sheet of cleaner 42 has been used, the bolts 43 are removed for the replacement of the cleaner 42.

The use of optical fibers for the photoelectric detector 17 of the foregoing embodiment makes it possible to detect soils with ease even at a location of limited space around the rolls of the tablet printing machine. However, the optical fiber need not always be used for the detector 17.

Although the transfer surface 10*a* of the transfer roll 10 is checked for the detection of soiling with tablets or with soils in the ink according to the above embodiment, it is also possible to detect soiling of the ink on the design roll 11 by separating the second abnormal signal detecting circuit 25 from the photoelectric detector and connecting the circuit 25 to another photoelectric detector which is opposed to the surface of the design roll 11 in corresponding relation to the transfer surface 10*a*.

The roll soiling detecting unit 12 and the roll cleaning unit 13 are not limited to those of the foregoing embodiment but can be suitably modified. While both of these units 12 and 13 are incorporated into the tablet printing machine according to the embodiment, only one of them may be provided. When the roll soiling detecting unit only is provided, the printing machine is adapted to automatically stop upon detecting soiling of the roll, and the roll is thereafter cleaned by a suitable method. When the roll cleaning unit alone is provided, the roll can be cleaned full-automatically at a predetermined time interval, or semi-automatically periodically or when found necessary by the operator.

What is claimed is:

1. A tablet printing machine comprising:

a roll cleaning unit comprising a cleaner to be impregnated with a cleaning liquid and adapted for pressing contact with a transfer roll of the printing unit thereof during the rotation of the transfer roll, a cleaning roll having a plurality of furrows formed in its outer periphery and dividing the outer periphery into a plurality of ridges circumferentially thereof, drive means for intermittently rotating the cleaning roll by one or at least two ridge pitches at a time, the cleaner being wound around the outer periphery of the cleaning roll along the ridges and the furrows, and means for supplying the cleaning liquid to the cleaner at the portions thereof over the ridge surfaces along the outer periphery of the cleaning roll.

2. A tablet printing machine comprising:

a roll soiling detecting unit for optically detecting soiling of the surface of a roll of the printing unit of the machine, and a roll cleaning unit including a cleaner to be impregnated with a cleaning liquid and adapted for pressing contact with a transfer roll in rotation of the printing unit;

wherein the roll cleaning unit comprises a cleaning roll having a plurality of furrows formed in its outer periphery and dividing the outer periphery into a plurality of ridges circumferentially thereof, drive means for intermittently rotating the cleaning roll by one or at least two ridge pitches at a time, the cleaner being wound around the outer periphery of the cleaning roll along the ridges and the furrows, and means for supplying the cleaning liquid to the cleaner at the portions thereof over the ridge surfaces along the outer periphery of the cleaning roll.

3. A tablet printing machine employing a roll printer comprising:

a photoelectric detector means positioned opposed to said roll of the printing unit;

first signal processing circuit coupled to the output of said photoelectric detector means for removing from said outputted signal the component frequencies lower than a predetermined frequency which is indicative of ink soiling or roll eccentricities;

first comparing means for comparing the resultant signal, from said first signal processing circuit with reference signals to detect soiling of said roll by broken tablets;

second signal processing circuit coupled to the output of said photoelectric detector means for removing from said outputted signal the component frequencies higher than a predetermined frequency which is indicative of soiling of the roll surface by tablets or surface irregularities; and second comparing means for comparing the resultant signal from said second signal processing circuit with reference signals to detect soiling in the ink.

4. A tablet printing machine employing a roll printer comprising:

a photoelectric detector means positioned opposed to said roll of the printing unit;

first signal processing circuit coupled to the output of said photoelectric detector means for removing from said outputted signal the component frequencies lower than a predetermined frequency which is indicative of ink soiling or roll eccentricities;

first comparing means for comparing the resultant signals, from said first signal processing circuit with reference signals to detect soiling of said roll by broken tablets;

second signal processing circuit coupled to the output of said photoelectric detector means for removing from said outputted signal the component frequencies higher than a predetermined frequency which is indicative of soiling of the roll surface by tablets or surface irregularities;

second comparing means for comparing the resultant signal form said second signal processing circuit with reference signals to detect soiling in the ink; and a roll cleaning unit including a cleaner adapted to be impregnated with a cleaning liquid which is brought into rotatable contact with said roll in response to the resulting signals from said first and second comparing means.

5. A tablet printing machine as defined in claim 4 wherein the roll cleaning unit comprises a cleaning roll, drive means for intermittently rotating the cleaning roll, and means for supplying the cleaning liquid to the cleaner, the cleaner being wound around the outer periphery of the cleaning roll.

* * * * *